US005531383A

United States Patent [19]

Pacht

[11] Patent Number: 5,531,383

[45] Date of Patent: Jul. 2, 1996

[54] SWIVEL JET ASSEMBLY

[75] Inventor: Amos Pacht, Houston, Tex.

[73] Assignee: Butterworth Jetting Systems, Inc., Houston, Tex.

[21] Appl. No.: 418,509

[22] Filed: Apr. 7, 1995

Related U.S. Application Data

[62] Division of Ser. No. 250,442, May 27, 1994.

[51] Int. Cl.[6] ..... B05B 3/06

[52] U.S. Cl. ..... 239/251; 239/553

[58] Field of Search ..... 239/228, 251, 239/548, 552, 553, 553.5

[56] References Cited

U.S. PATENT DOCUMENTS

| | | | |
|---|---|---|---|
| 1,919,244 | 7/1933 | Munz | 239/252 |
| 3,987,963 | 10/1976 | Pacht | 239/124 |
| 4,164,325 | 8/1979 | Watson | 239/252 |
| 4,221,271 | 9/1980 | Barker | 239/553.5 |
| 4,349,154 | 9/1982 | Pacht | 239/124 |
| 4,593,858 | 6/1986 | Pacht | 239/126 |
| 4,690,325 | 9/1987 | Pacht | 239/124 |
| 4,747,544 | 5/1988 | Kranzle | 239/252 |
| 4,759,504 | 7/1988 | Woodward | 239/76 |
| 4,828,178 | 5/1989 | Tucker et al. | 239/553 |
| 5,060,862 | 10/1991 | Pacht | 239/252 |
| 5,060,863 | 10/1991 | Hammelmann | 239/251 |
| 5,171,136 | 12/1992 | Pacht | 417/571 |
| 5,224,686 | 7/1993 | Pacht | 251/282 |
| 5,236,126 | 8/1993 | Sawade et al. | 239/252 |
| 5,253,808 | 10/1993 | Pacht | 239/124 |

FOREIGN PATENT DOCUMENTS

| | | |
|---|---|---|
| 2217234 | 10/1989 | United Kingdom . |
| 2221630 | 2/1990 | United Kingdom . |

*Primary Examiner*—Karen B. Merritt

*Attorney, Agent, or Firm*—Browing, Bushman, Anderson & Brookhart

[57] ABSTRACT

A swivel jet assembly 20 for a fluid distribution system delivers high pressure fluid from a pressurized fluid source to an object to be cleaned. A bearing housing 46 is removably affixed to a swivel body 32 having an inlet port 34 and a fluid transmission passageway 36 therethrough. A hollow shaft 40 has an upstream end positioned within the swivel body and a downstream end extending outward for engagement with a nozzle assembly 30. One or more nozzle jets 116, 118 are supported directly within a nozzle housing, and are angled for causing a torque in response to the high pressure discharged from the nozzle jets. A speed control device within the swivel housing includes a plurality of pins 58 each movable radially outward in response to centrifugal force for engagement with the swivel housing. The swivel is of the in line design, and a thrust bearing 66 is provided within the swivel housing upstream from the swivel speed control device. The nozzle assembly is designed for easy service and includes large angle flow distribution passageways for reducing the pressure drop across the nozzle assembly and for producing a desired spray pattern.

17 Claims, 1 Drawing Sheet

SWIVEL JET ASSEMBLY

This is a Division of application Ser. No. 08/250,442, filed May 27, 1994.

FIELD OF THE INVENTION

The present invention relates to a high pressure fluid delivery system which includes a fluid discharge nozzle rotatable in response to reaction forces from the fluid flow. More particularly, the present invention is directed to a high pressure system which may be positioned at the end of a hand-held gun lance which in turn is connected to a fluid pump for cleaning applications.

BACKGROUND OF THE INVENTION

Hand-held valve assemblies have been used for decades to clean the inside walls of tubular members with high pressure water. The valve assembly, which is commonly referred to as a gun, may be connected to a stationary high pressure fluid source, such as a pump. Fluid is discharged from the nozzle end of the gun and, for many purposes, may be discharged at pressures at 10,000 psi or more. For applications such as cleaning heat exchanger tubes, it is desirable that the nozzle rotate with respect to upstream valve assembly components of the hand-held gun. Swivels have accordingly been used between the nozzle and the gun body to achieve nozzle rotation, thereby improving the efficiency of the cleaning operation. U.S. Pat. No. 3,987,963 discloses a high pressure gun with a swivel for rotating the nozzle with the elongate gun barrel or lance. An improved swivel having a seal cartridge and a cap with vent openings is disclosed in U.S. Pat. No. 4,690,325.

It is desirable to minimize friction in the swivel, so that rotation of the nozzle is obtained at relatively low fluid pressure, and so that the maximum possible pressure is supplied to the nozzle to perform the desired cleaning operation. On the other hand, the nature of a swivel rotatably responsive to high pressure fluid flow is such that, once the rotatable elements start rotating, their rotational speed tends to increase, thereby causing the nozzle to rotate at excessively high speeds. Accordingly, sufficient friction must be provided to maintain the desired balance which will allow the nozzle to rotate, but will not allow the nozzle to rotate at excessively high speeds.

One technique for achieving this desired balance includes the use of a magnetic rotor assembly, as disclosed in U.S. Pat. No. 5,060,862. The magnetic rotor assembly within a swivel of the high pressure gun significantly complicates the cost and the weight of the swivel. The gun operator typically is manually holding the gun body, and the swivel and nozzle are provided at the discharge end of an elongate gun barrel or lance. High swivel weight is particularly undesirable since the effective weight of the swivel is undesirable enhanced by the cantilevered lance. Prior art nozzles typically have a weight of from 50 ounces to 90 ounces, and accordingly this weight and the associated cost of a swivel with a magnetic rotor assembly significantly detract from the advantages of a high pressure gun with a rotatable nozzle.

Another problem with high pressure nozzle and swivel assemblies relates to the flow path of fluid between the inlet to the swivel and the discharge from the nozzle jets. In many guns, high pressure fluid is transmitted through a flow path which has various 90 degree bends. These turns and flow path bends not only decrease the final fluid pressure to the nozzle, but also tend to adversely affect the desired pattern of fluid discharged from the plurality of nozzle jets, thereby adversely affecting the cleaning efficiency. A desired swivel and nozzle assembly is thus able to transmit high pressure fluid at a reasonable flow rate with a minimum pressure drop across the swivel and nozzle assembly.

Swivels for high pressure fluid transmission generally can be classified as either being of the balanced system type or the in line type. A balanced system swivel balances the fluid forces axially acting on the hollow shaft which supplies fluid to the nozzles, thereby avoiding problems associated with axial thrust forces being exerted on the hollow shaft. The balanced system swivel unfortunately must have a relatively large radial design, since fluid flow between the shaft and the nozzles is generally perpendicular to the axis of the hollow shaft, i.e., fluid turns 90 degrees as it exits the shaft and flows toward the nozzles. Balanced system swivels typically experience a large amount of fluid leakage, often as much as 30 percent or more, partially because of the comparatively large sealing diameter required by this design. The relatively large radial dimension practically required for the balanced system swivel also disadvantageously increases the weight of the swivel.

An in line swivel transmits fluid in a substantially axial direction to and through the hollow shaft of the swivel. Accordingly, this type of swivel generally results in significantly less of a pressure drop than the balanced system swivel. Since the seal between the stationary bushing and the rotary shaft may have a smaller diameter than a balanced system seal, the in line swivel also generally experiences less fluid loss than a balanced system swivel. Unfortunately, the fluid pressure which axially acts upon the rotating shaft must countered, and the cost and maintenance of thrust bearings have significantly limited acceptance of this type of swivel.

Prior art swivel and nozzle assemblies typically cannot be easily disassembler and repaired. The design and configuration of the swivel and nozzle are typically complex, and the gun operator frequently cannot service the swivel and nozzle assembly at a job site. Accordingly, the gun operator tends to continue to use the gun after the time when the gun should be serviced, which causes further damage to components of the gun and also decreases the efficiency of the cleaning operation.

The disadvantages of the prior art are overcome by the present invention, and an improved swivel and nozzle assembly for a high pressure gun are hereinafter disclosed. The swivel jet assembly according to the present invention is relatively inexpensive, is light weight, results in a relatively low pressure drop and thus transmits high fluid pressure to the nozzle jets, results in a desired uniform spray pattern, and is easy to disassemble and service.

SUMMARY OF THE INVENTION

An exemplary swivel and nozzle assembly according to the present invention, which may be referred to as a swivel jet assembly, comprises a swivel body having a fluid inlet and a fluid transmission passageway therethrough, a rotatable hollow shaft having one end positioned within the swivel body and an opposing end extending outward therefrom, a bearing assembly surrounding an intermediate portion of the rotatable hollow shaft, a nozzle base affixed to the opposing end of the hollow shaft, and a nozzle housing attached to the nozzle base and housing a plurality of nozzle jets therein. A bearing housing is affixed to the swivel body, and a bearing assembly acts between the stationary beating housing and the rotatable hollow shaft. A centrifugal speed control assembly is also housed within the bearing housing, which includes a rotor and a plurality of pins each radially movable within a corresponding slot within the rotor for forced engagement with the bearing housing. As the rotational speed of the hollow shaft and thus the rotor increases, increased centrifugal force acting on each of the plurality of pins increases the frictional force, thereby tending to limit the rotational speed of the hollow shaft and the nozzle jets.

The nozzle assembly is simplistic in construction, yet results in a low pressure drop to the plurality of nozzle jets. An axially aligned inlet in the nozzle base extends radially outward in a plurality of directions from the nozzle central axis at a high angle of about 160 degrees. The nozzle housing is adapted for receiving a plurality of nozzle jets, with each jet having its axis slightly inclined to produce rotation but otherwise substantially parallel to and spaced radially outward from the nozzle central axis. One or more dowel pins extend between the nozzle base and the nozzle housing for aligning the fluid passageways in the nozzle base with the corresponding passageways in the nozzle housing. A bolt substantially aligned with the central nozzle axis structurally interconnects the nozzle housing and nozzle base, while seals provide a fluid tight connection between the nozzle housing and nozzle base.

The bearing assembly within the bearing housing includes both radial and thrust bearings. The thrust bearings, which resist the axial force acting on the hollow shaft due to the in line design of the swivel, are provided upstream from the centrifugal speed control assembly. A radially Outward extending shoulder on the rotatable hollow shaft acts on one side of the thrust bearing, while the other side of the thrust bearing acts against a radially inwardly extending lip on the bearing housing which serves as a stop to the thrust bearing and thus counters the axially transmitted forces created by the high pressure fluid. By positioning the thrust bearing axially opposite the nozzles with respect to the speed control assembly, vibrational forces created by the nozzle assembly have significantly less affect on the thrust bearing, thereby increasing the thrust bearing life. The swivel jet assembly of the present invention may be easily serviced by the operator, as explained subsequently.

It is an object of the present invention to provide an improved swivel for a high pressure fluid cleaning device. The swivel includes a centrifugal speed control assembly having a plurality of radially movable members for creating increased frictional forces in response to increased rotational velocity.

Another object of this invention is a swivel jet assembly for a high pressure fluid cleaning device which is relatively lightweight and inexpensive compared to magnetic rotor assemblies.

Yet another object of the invention is a nozzle assembly for a high pressure fluid cleaning device which is also lightweight and compact in construction, and which results in a comparatively low pressure drop.

Still another object of the invention is an improved in line swivel for a high pressure swivel jet assembly having a thrust bearing positioned upstream from a speed control assembly to extend the life of the thrust bearing and thus the swivel.

It is a significant feature of the invention that the centrifugal speed control mechanism of the high pressure swivel is compact, thereby allowing the swivel assembly to be designed for reliably transmitting high pressure fluids while also being positioned within a relatively small diameter tube which requires cleaning.

Another feature of this invention is that the nozzle assembly includes large flow diversion angles of approximately 150 degrees or more to minimize the pressure drop across the nozzle assembly and achieve a desired spray pattern from the nozzle jets.

Yet another feature of the invention is that the bearing assembly within the bearing housing of the swivel includes radial bearings spaced at axially opposing ends of the speed control assembly, and one or more thrust beatings each spaced upstream from the speed control assembly.

The significant advantage of this invention is that each of the nozzle assembly and the swivel assembly may be easily disassembled and serviced. A related advantage of the invention is that the swivel jet assembly is relatively inexpensive to manufacture.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
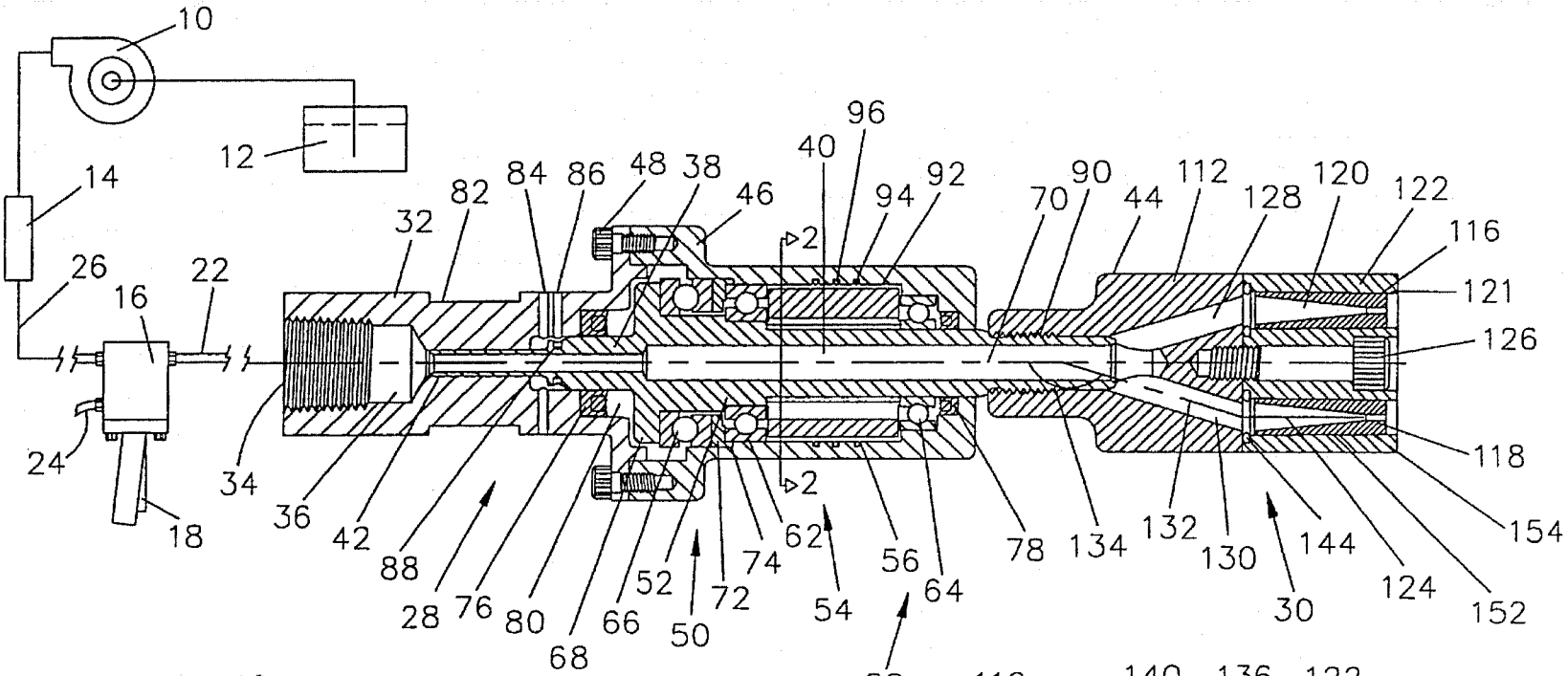
FIG. 1 is a side view, partially in cross-section, of a swivel jet assembly according to the present invention illustrated within a schematic representation of a high pressure fluid delivery system.

FIG. 1 illustrates schematically a typical high pressure fluid system according the present invention which is suitable for cleaning various objects, such as the interior of a heat exchanger tube. The cleaning system comprises a high pressure pump 10 which receives fluid, e.g., water or another liquid with an optional abrasive or detergent, from a source 12. The pump discharges high pressure fluid to a remotely actuated dump valve 14, which controls the flow of high pressure fluid to each of a plurality of hand-held valve assemblies or guns 16, one of which is depicted in FIG. 1. Each gun 16 includes some type of trigger mechanism 18 for controlling the flow of fluid from the body of the gun to swivel jet assembly 20. Those skilled in the art will appreciate that the swivel jet assembly 20 as shown in FIG. 1 is thus supported at the end of the gun barrel or lance 22, which is secured to the gun body in a conventional manner. The components upstream of the swivel jet assembly 20 are conventional in a high pressure fluid delivery system. Electrical lines 24, which may be embedded into or wrapped around flexible hose 26, connect the dump valve 14 and the gun 16. Further information regarding a suitable pump, dump valve assembly, and components within the gun body are disclosed in U.S. Pat. Nos. 4,349,154, 4,593,858, 4,759,504, 5,171,136, 5,224,686 and 5,253,808, each of which is incorporated by reference.

The swivel jet assembly 20 comprises a swivel assembly 28 and a jet nozzle assembly 30..The swivel assembly 28 includes a swivel body 32 having a threaded inlet port 34 and a fluid transmission passageway 36 through the body 32. A hollow spindle or shaft 38 has a central flow path 40 therein, and has its upstream end 42 positioned within the body 32, and its opposing downstream end 44 extending outwardly from body 32. A bearing housing 46 is removably affixed to body 32 by a plurality of circumferentially arranged bolts 48. Bearing assembly 50 surrounds an intermediate portion 52 of the shaft 38, and acts between the bearing housing 46 and the intermediate portion 52 of the shaft 38 to facilitate rotation of the shaft 38 and thus the nozzles with respect to the gun body 16.

Figure 2:
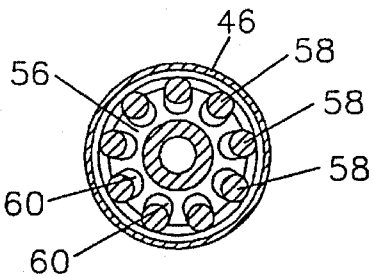
FIG. 2 is a cross-sectional view of the swivel jet assembly as shown in FIG. 1 taken along line 2—2.

A centrifugal speed control assembly 54 is also housed within the bearing housing 46, and comprises a rotor 56 (see FIG. 2) rotatably secured to the shaft 38 and a plurality of pins 58 each positioned within a respective slot 60 extending radially outward from the rotor. As shown in FIG. 2, each slot 60 has a substantially U-shaped cross-sectional configuration which allows the diameter of the rotor 56 to be minimized without creating high stress areas within the rotor. Each pin 58 is thus free to move radially outward into forced engagement with the bearing housing, as explained further subsequently. The bearing assembly 50 preferably comprises a radial bearing 62 positioned upstream from the speed control assembly 54, and a similar bearing 64 positioned downstream from the speed control assembly. Each radial bearing facilitates rotation of the shaft 38 with respect to the housing 46, and additional upstream and/or downstream radial bearings may be added, if desired. Bearing assembly 50 also includes a thrust bearing 66 provided upstream from the speed control assembly 54, and is preferably provided upstream from each of the radial bearings, as shown in FIG. 1.

The hollow shaft 38 includes an annular radially outwardly extending shoulder 68 which acts on the thrust bearing 66 to withstand the high pressure fluid forces acting on the upstream end of the hollow shaft. These forces, which are substantially aligned with the central axis 70 of the assembly 20, are transmitted through the thrust bearing 66 to a spacer washer 72, which in turn is prevented by a radially inwardly directed annular lip 74 on the bearing housing 36 from moving toward the downstream end 44 of the shaft 48. Only a single thrust bearing will generally be necessary, although it is a feature of this invention that one or more thrust bearings may be provided each upstream rather than downstream from the speed control assembly 54, so that thrust forces are not transmitted through the speed control assembly. Also, this feature of the invention substantially reduces wear on the thrust bearing, since this positioning of the thrust bearing within the assembly 20 minimizes vibrational forces caused by rotation of the nozzle assembly from adversely affecting the thrust bearing, thereby significantly increasing the life of the thrust bearing. As shown in FIG. 1, a radially outward surface of the thrust bearing 68 is greater than a radially outward surface of upstream radial bearing 62, and a radially outward surface of upstream bearing 62 is greater than a radially outward surface of downstream bearing 64. For a compact design, it may also be seen in FIG. 1 that the housing engagement members which serve as the speed control device do not extend radially outward from the central axis 70 a distance further than an outer surface of the upstream radially bearing 62.

Cup seals 76 and 78 provide sealing engagement between the swivel body 32 and the shaft 38 and between the bearing assembly 46 and the shaft 38, respectively. Those skilled in the art will appreciate that the interior 80 of the swivel assembly 28 axially between the seals 76 and 78 and radially between the rotating shaft 38 and both the swivel body 32 and the bearing housing 46 may be packed with a suitable lubricant, such as grease. Exterior surface 82 on body 32 may be provided with a hexagonal configuration to facilitate torqued rotation of the assembly 28 with respect to the lance 22. A plurality of circumferentially spaced vent apertures 84 upstream from the seal 76 allow for venting of high pressure fluids, as disclosed in U.S. Pat. No. 4,690,325. Another aperture 86 within the body 32 is axially positioned for alignment with pocket 88 within the shaft 38. A small diameter pin (not shown) may be inserted through hole 86 and into the pocket 88 to rotationally lock the shaft 38 to the bearing housing 46, thereby allowing the jet nozzle assembly 30 to be threadably disconnected from the threads 90 on the downstream end of the shaft 38.

Referring to FIGS. 1 and 2, it should be understood that the purpose of the centrifugal speed control assembly 54 is to prevent excessively high rotation of the shaft 38 and thus the nozzle assembly 30 threadably connected thereto. Those skilled in the art will appreciate that the orientation of the jets in the nozzle assembly will cause rotation of the nozzle assembly and thus the shaft 38. Preferably the rotational speed of the nozzle is controlled, and is typically within the range of from 1,000 to 5,000 rpm. The created rotational torque will be a function of fluid flow rate through the nozzles, fluid pressure, and the angle of the nozzle inclination. For many application, the nozzles will be angled at from 5° to 20° to produce the desired torque level. Once this rotational torque induced by the jet reaction forces created by liquid pressure acting on the nozzle assembly overcomes the static forces acting on the rotatable shaft 38, the shaft 38 will begin to rotate. This rotation, if not controlled, will quickly intend to increase beyond an acceptable limit. Accordingly, the speed control assembly 54 acts to increase fictional forces which tend to slow down the acceleration of the shaft 38, so that the rotational speed of the nozzle is maintained within an acceptable limit. Equally important, the speed control assembly of the present invention minimizes frictional forces acting on the shaft 38 when fluid pressure is low, so that the nozzle assembly 30 will be able to rotate during a wide range of fluid pressures.

Rotor 56 as shown in FIG. 2 may be rotatably affixed to the shaft 38, e.g., by press fitting or by providing small keyways and a key. Alternatively, the shaft 38 and rotor 56 may be fabricated as a unitary component. When the rotor 56 rotates at a low velocity, a small centrifugal force is imparted to each of the plurality of pins 58 housed circumferentially about the shaft, so that only a small force presses each of the pins 58 radially outward into engagement with the beating housing. As the speed of the rotor 56 increases, however, the centrifugal force on each of the pins 58 will increase as a direct function of the weight of each pin and the radial distance of each pin from the centerline 70, and as a square of the angular velocity of the rotor 56. Each pin preferably has a substantially uniform weight, and the radial distance of each pin from the axis 70 remains substantially constant, so that the centrifugal force acting on each of the pins 58 is directly a function of the square of the rotational velocity of the rotor. The frictional forces created by the engagement of each pin with the bearing housing 48 in turn is a function of the coefficient of friction between the engaging surfaces and the radially directed centrifugal force. Since the dynamic coefficient of friction between each pin 58 and the bearing housing remains substantially constant, it should be understood that the frictional forces between the plurality of pins 58 and the bearing housing 46 will be a function of the square of the rotational velocity of the shaft 38. The centrifugal speed control assembly 54 thus inherently slows down acceleration of the shaft 38 as its rotational speed increases.

Pins 58 are currently preferred members for forced engagement with the bearing housing to vary the frictional forces, since the pins 58 are easy to manufacture and do not cause excessive wear on either the bearing housing or the rotor 56. A plurality of bearing housing engagement member are desired, and preferably at least three such bearing engagement members are uniformly positioned circumferentially about the rotor. The embodiment as described herein consists of nine pins each circumferentially arranged at 40 degree arcs from its two adjacent pins. It should be understood, however, that bearing housing engagement members having different configurations may be rotatably fixed with respect to the rotor 56 yet be free to move radially outward into forced engagement with the bearing housing. Elongate pins having a octagonal or hexagonal configuration may thus be utilized, as may non-elongate members, such as pads or balls.

According to the present invention, each of the pins 56 may move radially outward in response to the created centrifugal force to engage an inner cylindrical surface 92 on the bearing housing. According to the embodiment as shown in FIGS. 1 and 2, however, each of the pins 58 moves radially outward to engage a plurality of elastomeric O-rings 94 each positioned within a respective groove 96 provided within the bearing housing. The purpose of the O-rings 94 is two-fold: (1) they increase the coefficient of friction with the pins, so that maximum rotational speed of the shaft 38 may be more easily controlled, and (2) the radial outward movement of each of the pins creates both frictional forces between the pins and each of the O-rings and compressional forces which act on and compress each of the O-rings 94. Those skilled in the art will appreciate that the interior surface of the bearing housing 46 which is engaged by the plurality of pins 58 may alternatively be coated or provided with a thin walled sleeve affixed to the bearing housing for altering the coefficient of friction and thus the frictional forces created by the centrifugal force acting on the pins.

Swivel assembly 28 as shown herein thus has an improved speed control assembly for limiting the rotational speed of the shaft 38. Since the speed control assembly is of the in line design configuration, fluid loss from the speed control assembly 28 compared to balanced swivel assembly is low, and may be easily further reduced by altering the axial length and type of sealing members between the rotatable shaft 38 and both the swivel body 32 and the bearing housing 46. Increased friction between the pins and the bearing housing results in the generation of heat.

FIG. 1 illustrates the jet nozzle assembly 30 threadably connected to the shaft 38 at threads 90. Assembly 30 comprises a nozzle seat or base 112 which has an inlet port 114 aligned with axis 70 and sized for receiving the downstream end 44 of the shaft 38. The nozzle assembly 30 may include any selected number of nozzle jets, and for purposes of explanation two nozzle jets or inserts 116 and 118 are each positioned within a respective cavity 120 provided within nozzle housing 122. Each nozzle jet or insert has a generally sleeve shaped configuration, with an outer generally cylindrical surface and a flow path therein. As shown in FIG. 1, each insert 116, 118 many have its central axis 124 positioned substantially within a vertical plane parallel to and spaced radially outward from axis 70, but angled slightly within a horizontal plane, thereby creating torque on the nozzle assembly.

Figure 3:
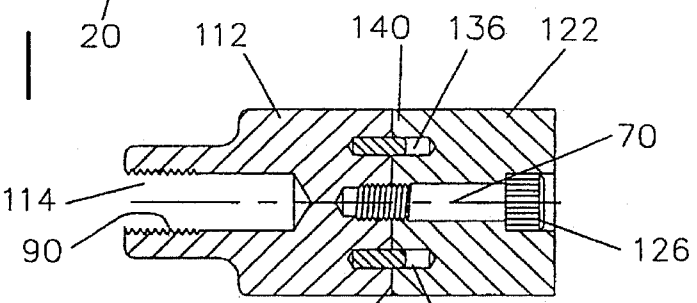
FIG. 3 is a top view, partially in cross-section, of the nozzle assembly shown in FIG. 1.

To obtain a compact configuration for the nozzle assembly 30, each insert is fixed directly within a respective cavity 120 within the nozzle housing 122 and is thus supported by the nozzle housing, rather than being fitted within a fixture which in turn is threadably connected to the nozzle housing. The outer generally cylindrical surface of each insert and the corresponding surface of each cavity 120 may be slightly tapered, so that the inserts may be pressed into a respective cavity 120 from the upstream side of the nozzle housing. Other techniques may be used to retain the inserts within the nozzle housing, such as providing a shoulder on each insert for engagement with the nozzle housing to prohibit its discharge from the nozzle housing 122. The outer generally cylindrical surface 152 of each nozzle jet 116, 118 is in engagement with the similarly configured support surface 154 within the nozzle housing 122, so that the radial position of each nozzle jet is fixed by the nozzle housing, not by a fixture which in turn is secured to the nozzle housing. By radially supporting each nozzle jet by a stop or support surface provided directly on the nozzle housing, the diameter and thus the weight of the nozzle housing may be minimized. A hexhead bolt 126 substantially aligned with axis 70 structurally interconnects the nozzle base 112 and the nozzle housing 122, as shown in FIGS. 1 and 3.

The inlet port 114 is fluidly connected to a pair of angle transmission paths 128 and 130 each provided within the nozzle base 112. The downstream end of each passageway 128, 130 within the nozzle base 112 is aligned for fluid transmission to the respective cavity 120 within the nozzle housing which receives the corresponding insert 116, 118. It is a particular feature of the present invention that the flow path through the nozzle assembly retains a substantially streamline configuration and avoids 90 degree bends through the nozzle assembly, thereby substantially enhancing the desirable spray pattern from the nozzle assembly. More particularly, each of the passageways 128 and 130 has a respective axis 132 which forms an angle 134 of at least 150 degrees, and preferably at least 160 degrees, with respect to axis 70. This same angle 134 (plus a slight angular variation due to the slight angling of the inserts to produce the pressure generated torque) thus exists between the axis 132 and the axis 124 of each insert. Fluid flowing through the nozzle assembly 30 is thus diverted only slightly through two angles each in excess of about 150 degrees, thereby resulting in the substantially simplistic yet streamline configuration of fluid flow through the nozzle assembly 30. Referring to FIG. 3, it may be seen that a pair of dowel pins 136, 138 may be used to align each of the passageways 128 and 130 within the nozzle base with the corresponding cavity 120 within the nozzle housing 112. The planar face 140 on the downstream end of the nozzle base 112 thus mates with the planar upstream face 142 on the nozzle housing 122, and an O-ring 144 provides a static seal between the nozzle base and nozzle housing. Housing 122 thus has an end face 121 that is spaced axially opposite the rotatable hollow shaft 38 with respect to the nozzle base 112. The plurality of nozzle jets or inserts 116, 118 are mounted within the nozzle housing 122 for discharging fluid through the end face 121 of the nozzle housing. Each nozzle jet may have a nozzle jet axis 124 that is substantially aligned with and space radially outward from the central axis 70 of the nozzle base.

To remove the nozzle assembly 30 from the swivel assembly 28, a pin may be inserted in passageway 86 and into the pocket 88 provided in the shaft 38, thereby rotatably locking the shaft 38 to the bearing housing 32 and allowing the operator to rotate the nozzle assembly relative to the shaft 38 and thus break apart the threads 90. Nozzle assembly 30 may be serviced and inserts 116, 118 replaced by merely unthreading the hexhead bolt 126 and revolving each of the O-rings 144 and the inserts 116, 118 from the upstream face 142 of the nozzle housing 122. Nozzle assembly 30 may be reassembled and reattached to the swivel assembly in reverse operation. Those skilled in the art will readily appreciate the benefits of easy serviceability for the nozzle assembly 30. The nozzle assembly 30 as shown in FIGS. 2 and 3 has a comparatively low pressure drop, yet is able to achieve a desired set pattern of spray from the nozzle assembly. The assembly 30 is also simplistic in design and construction, which facilitates service by the cleaning operator at the job site. Those skilled in the art will recognize that a customer may easily replace one pair of inserts 116, 118 with another pair of inserts during a field servicing operation and thereby change the desired pattern of fluid discharged from the nozzle assembly 30.

Various modifications to the high pressure fluid delivery system and the swivel jet assembly described herein should be apparent from the above description of a preferred embodiment of the invention. For example, the swivel body 32 and the bearing housing 46 could, at least theoretically, be manufactured as a single swivel housing unit. Although the invention has been described in detail for this embodiment, it should be understood that this explanation is for illustration, and that the invention is not limited to the described embodiment. Various alternative equipment and operating techniques will thus be apparent to those skilled in the art in view of this disclosure. Such modifications are contemplated and may be made without departing from the spirit of the invention, which is defined by the claims.

What is claimed is:

1. A nozzle assembly for discharging fluid from a rotatable hollow shaft having a central axis of rotation, an upstream end of the shaft positioned within a swivel housing and a downstream end of the shaft in fluid communication with the nozzle assembly, the nozzle assembly comprising:

a nozzle base having an inlet port with a central axis substantially aligned with the central axis of the hollow shaft;

a plurality of fluid transmission passageways within the nozzle base for transmitting fluid from the nozzle base inlet port;

a nozzle housing removably interconnected with the nozzle base, the nozzle housing having an end face spaced axially opposite the rotatable hollow shaft with respect to the nozzle base;

a plurality of nozzle jets each mounted within the nozzle housing and positioned for fluid communication with a respective one of the plurality of fluid transmission passageways for discharging fluid through the end face of the nozzle housing; and a securing member for removably securing the nozzle base to the nozzle housing.

2. The nozzle assembly as defined in claim 1, further comprising:

each of the plurality of nozzle jets having a generally sleeve-shaped configuration with an outer generally cylindrical surface and a central flow path therein; and the nozzle housing includes a plurality of support surfaces each for engagement with the outer cylindrical surface of a corresponding nozzle jet for fixing the radial position of the plurality of nozzle jets within the nozzle housing.

3. The nozzle assembly as defined in claim 1, wherein:

the securing member is substantially aligned axially with the inlet port of the nozzle base; and each of the plurality of nozzle jets is positioned circumferentially about the securing member.

4. The nozzle assembly as defined in claim 1, further comprising:

an alignment member for aligning the nozzle housing with respect to the nozzle base to transmit fluid from the respective passageway in the nozzle base to the respective nozzle jet within the nozzle housing.

5. The nozzle assembly as defined in claim 1, wherein each of the nozzle jets has a nozzle jet axis substantially aligned with and spaced radially outward from the central axis of the nozzle base.

6. The nozzle assembly as defined in claim 1, wherein each of the fluid passageways through the nozzle base is angled at a flow distribution angle of at least 150 degrees with respect to the central axis of the nozzle base.

7. A nozzle assembly for discharging fluid from a hollow shaft, the nozzle assembly comprising:

a nozzle base having an inlet port with a central axis;

a plurality of fluid transmission passageways within the nozzle base for transmitting fluid from the nozzle base inlet port;

a nozzle housing removably interconnected with the nozzle base;

a plurality of nozzle jets each mounted within the nozzle housing and positioned for fluid communication with a respective one of the plurality of fluid transmission passageways, each of the nozzle jets having a nozzle jet axis substantially aligned with and spaced radially outward from the central axis of the nozzle base;

a securing member for removably securing the nozzle base to the nozzle housing; and a plurality of support surfaces fixed on the nozzle housing each for engagement with a respective one of the plurality of nozzle jets for fixing the position of the plurality of nozzle jets within the nozzle housing.

8. The nozzle assembly as defined in claim 7, further comprising:

each of the plurality of nozzle jets having a generally sleeve-shaped configuration with an outer generally cylindrical surface and a central flow path therein.

9. The nozzle assembly as defined in claim 7, wherein:

the securing member is substantially aligned axially with the inlet port of the nozzle base; and each of a plurality of nozzle jets are positioned circumferentially about the securing member.

10. The nozzle assembly as defined in claim 7, further comprising:

an alignment member for aligning the nozzle housing with respect to the nozzle base to transmit fluid from the respective passageway in the nozzle base to the respective nozzle jet within the nozzle housing.

11. The nozzle assembly as defined in claim 7, wherein each of the flow passageways through the nozzle base is angled at a flow distribution angle of at least 150° with respect to the central axis of the nozzle base.

12. A nozzle assembly for discharging fluid from a hollow shaft having a central axis, the nozzle assembly comprising:

a nozzle base having an inlet port with a central axis substantially aligned with the central axis of the hollow shaft;

a plurality of fluid transmission passageways within the nozzle base for transmitting fluid from the nozzle seat inlet port;

a nozzle housing removably interconnected with the nozzle base;

a plurality of nozzle jets each mounted within the nozzle housing and positioned for fluid communication with a respective one of the plurality of fluid transmission passageways;

each of the fluid passageways between the central axis of the nozzle base and a respective one of the plurality of nozzle jets being continually angled at a flow distribution angle of at least 150° with respect to the central axis of the nozzle base; and a securing member for securing the nozzle base to the nozzle housing.

13. The nozzle assembly as defined in claim 12, further comprising:

each of the plurality of nozzle jets having a generally sleeve-shaped configuration with an outer generally cylindrical surface and a central flow path therein; and the nozzle housing includes a plurality of support surfaces fixed thereon each for engagement with the outer cylindrical surface of a corresponding nozzle jet for fixing the radial position of the plurality of nozzle jets within the nozzle housing.

14. The nozzle assembly as defined in claim 13, wherein:

the securing member is substantially aligned axially with the inlet port of the nozzle base; and each of the plurality of nozzle jets is positioned circumferentially about the securing member.

15. The nozzle assembly as defined in claim 13, further comprising:

an alignment member for aligning the nozzle housing with respect to the nozzle base to transmit fluid from the respective passageway in the nozzle base to the respective nozzle jet within the nozzle housing.

16. The nozzle assembly as defined in claim 13, wherein each of the nozzle jets has a nozzle jet axis substantially aligned with and spaced radially outward from the central axis of the nozzle base.

17. A nozzle assembly as defined in claim 12, wherein:

the nozzle housing has an end face spaced axially opposite the hollow shaft with respect to the nozzle base; and the plurality of nozzle jets are positioned within the nozzle housing for discharging fluid through the end face of the nozzle housing.

* * * * *

UNITED STATES PATENT AND TRADEMARK OFFICE

CERTIFICATE OF CORRECTION

PATENT NO. : 5,531,383

DATED : July 2, 1996

INVENTOR(S) : Amos Pacht

It is certified that error appears in the above-indentified patent and that said Letters Patent is hereby corrected as shown below:

In column 10, line 50, change "flow" to --fluid--.

Signed and Sealed this

Twenty-sixth Day of November 1996

*Attest:*

Bruce Lehman

BRUCE LEHMAN

*Attesting Officer*

*Commissioner of Patents and Trademarks*